United States Patent [19]

Portier

[11] 3,984,988

[45] Oct. 12, 1976

[54] OBTURATING DEVICE, ESPECIALLY FOR INJECTION TUBES

[75] Inventor: Jean-Louis Portier, Paris, France

[73] Assignee: Soletanche, Paris, France

[22] Filed: Oct. 23, 1975

[21] Appl. No.: 625,080

[30] Foreign Application Priority Data

Nov. 7, 1974 France ..... 74.36922

[52] U.S. Cl. ..... 61/35; 61/36 R; 61/39

[51] Int. Cl.[2] ..... E02D 5/00

[58] Field of Search ..... 61/53.6, 53.5, 53.64, 61/53.68, 39, 45 B, 53.66, 35, 45 R, 36 R; 166/187, 285

[56] References Cited

UNITED STATES PATENTS

| | | | |
|---|---|---|---|
| 2,357,145 | 8/1944 | Standefer | 166/187 X |
| 3,494,134 | 2/1970 | Jorge | 61/45 R X |
| 3,530,675 | 9/1970 | Turzillo | 61/35 |
| 3,865,188 | 2/1975 | Doggett et al. | 166/285 |

FOREIGN PATENTS OR APPLICATIONS

| | | | |
|---|---|---|---|
| 259,462 | 1/1968 | Austria | 61/39 |

*Primary Examiner*—Dennis L. Taylor
*Attorney, Agent, or Firm*—Cooper, Dunham, Clark, Griffin & Moran

[57] ABSTRACT

The invention relates to an obturating device more particularly designed for operating with a cavity such as an injection tube. Said device comprises a hollow body adapted to be connected with a duct for feeding a fluid under pressure to be injected, such as a cementitious grout. The body is provided with outlet ports at the vicinity of at least one of its ends, said end being covered by a flexible and resilient sleeve tightly engaged over the body and covering said outlet port. The said sleeve is provided with a comparatively thick bottom located between said end and a backing-piece, the assembly being arranged to be introduced in the injection tube or cavity with such a clearance that deformation of the bottom of the sleeve or sleeves under the effect of the pressure of the fluid ensures obturation of said tube or cavity.

10 Claims, 5 Drawing Figures

OBTURATING DEVICE, ESPECIALLY FOR INJECTION TUBES

This invention relates to obturating devices such those utilized for injecting fluids such as cementitious grouts into the ground.

It is known that, to perform such injections it is possible to place in the ground a tube bored with holes located at the places where the grout must be injected and provided with non-return valves. The grout is then injected by means of a hollow injection pipe introduced into the tube and terminated by a device provided with one or several outlets located between two obturating members which delimit in the said tube, a volume which is brought in front of the holes through which the grout must be injected.

Usually, said obturating members are provided with obturator cups made of leather or of rubber, similar to the packings of the pistons of bicycle-pumps. It is mandatory that the diameter of said cups be larger than the diameter of the tube, as otherwise the grout leaks before the cups has established the required tightness. Consequently, in order to introduce or to remove the obturating device, it is necessary to develop strains, sometimes considerable due especially to the fact that the grout begins to set at some places, for example under the cups. This requires, on one hand, a strong line of metal pipes and, on the other hand, an important manpower.

In order to meet said disadvantages, it has been proposed to use obturating members provided with sleeves inflatable either through loss of pressure upon the passage of the grout, or through separate circuits fed with an additional fluid, but such apparatus, either do not operate very accurately, particularly with no flow and high pressure, or are very expensive.

It is an object of the present invention to provide a simple and efficient obturating device which can be easily introduced and moved in the tube and which ensures automatically the required tightness under the effect of the pressure of the injection fluid.

For that purpose, the invention utilizes an obturating device comprising an expansible resilient cap and which mainly works under compression, thus ensuring the said device a long life and making easier its assembling and its disassembling.

Other characteristics of the invention are to be found in the following description. An embodiment of the invention is shown by way of example in the accompanying drawings.

Figure 2:
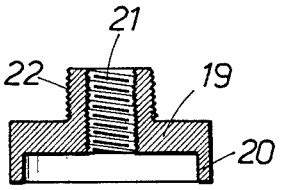
FIG. 2 is a sectional view of a backing piece of the device.

In the example represented on the drawing, an injection tube 1, driven in the ground, is sealed in the ground 2 through a bedding 3, formed through hardening of an appropriate grout, for example made of bentonite and cement.

In one or several determined locations, the tube 1 has holes 4, for example diametrically opposite and, in front of each series of holes 4, it is surrounded by a flexible and resilient outer flange 5, normally tightened on the tube and acting as a non-return valve upon possible injections.

Figure 1:
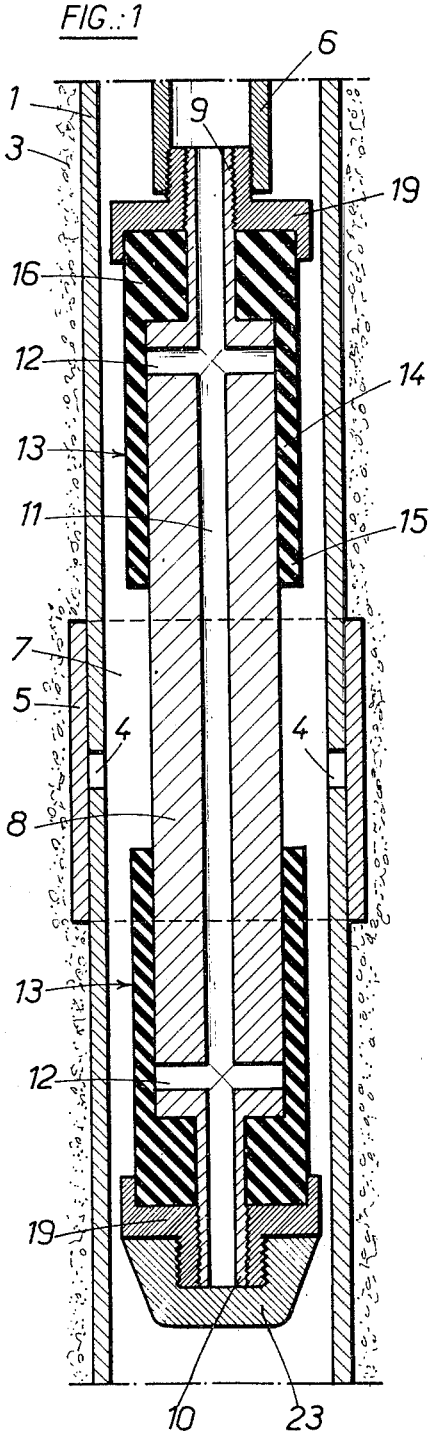
FIG. 1 is a diagrammatic view, in median longitudinal section, of a section of an injection tube provided with an obturating device according to the invention.

To perform an injection, an injection duct 6 is introduced in the tube 1. Said injection duct 6, which can be more flexible and lighter than a line of hollow metallic pipes, is provided with an obturating device allowing to isolate, in tube 1, a volume 7, in which the holes 4 of a same series open (FIG. 1).

According to the invention, the obturating device comprises a median body 8 which can slide with a clearance in the tube 1 and is terminated at its ends by threaded hollow rods 9 and 10.

The body 8 is provided right through with a median longitudinal channel 11, connected, in the vicinity of the ends of the body 8, with radial channels 12 opening in the outer surface of said body.

Figure 3:
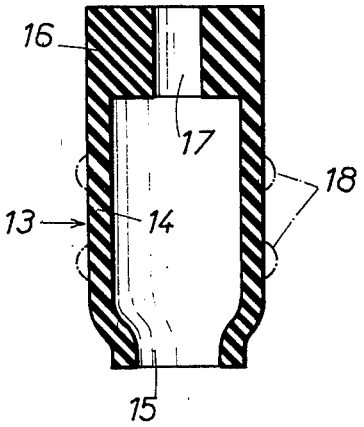
FIG. 3 is a similar view of the sleeve which constitutes a valve of the device.
Figure 4:
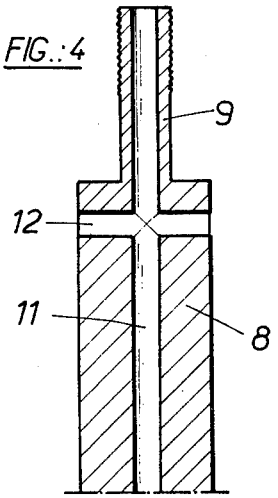
FIG. 4 is a similar view, but partial, of the body of the obturating device.

Each of the ends of body 8 are covered with a sleeve 13, made of rubber or similar flexible and resilient material, whose shape, at rest, is represented in FIG. 3.

Said sleeve has a cylindrical skirt 14, whose inner diameter is equal to or a little smaller than the outer diameter of the body 8 and which terminates, at one end, by a narrowed neck 15 and, at the other end, by a thick bottom 16, whose thickness is for example about the same as the diameter of the sleeve. Said neck has a central boring 17, whose diameter corresponds to that of the rods 9 or 10 of body 8. The length of the sleeves is sufficient for the same to extend widely beyond the outlets of the corresponding channels 12 (FIG. 1) and calculated in function of the distance between the axes of the holes 12, which are generally grouped by four or by eight, in the body 8. Outside, the skirt 14 can be provided with peripheral shoulders 18.

Over the bottom 16 of each of the sleeves 13, is engaged a backing piece 19 (FIG. 2), provided with a flange 20 fitting on the sleeve bottom and the axial length of which is smaller than the thickness of the said bottom, and with a threaded central boring 21, which allows to screw the said piece on the corresponding rod 9 or 10 of the body 8.

Figure 5:
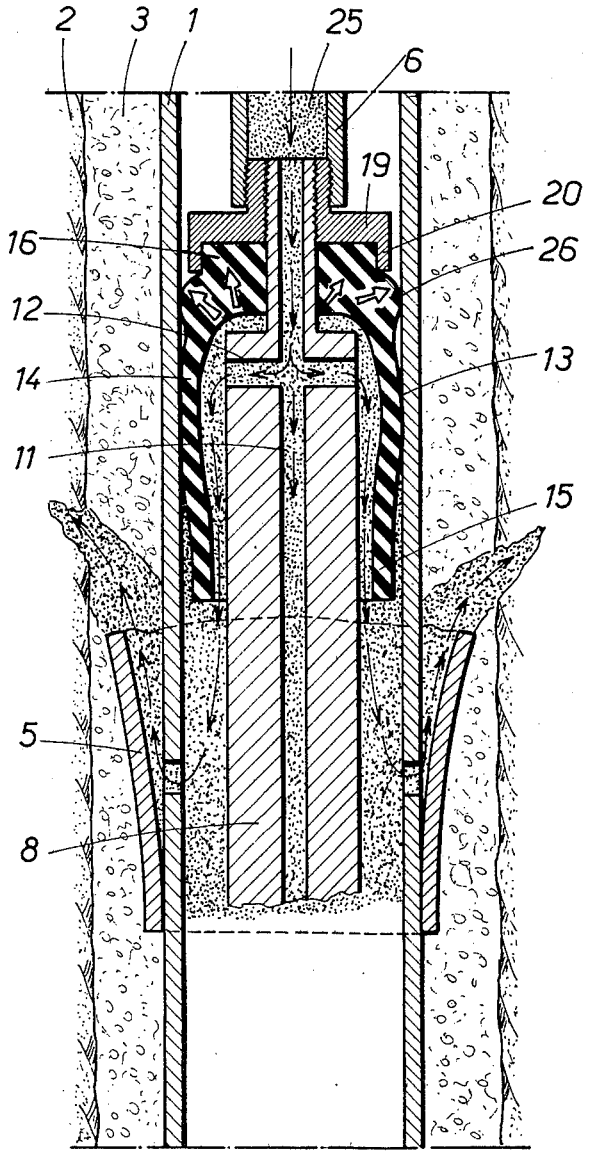
FIG. 5 is a view similar to FIG. 1, but which shows the operation of the obturating device during the injection.

The backing piece 19 also is provided with a threaded portion 22 by means of which it can be secured to the end of the injection duct 6, as can be seen at the top of FIGS. 1 and 5. At the lower end of the obturating device the backing piece is obturated by a drain cap 23, a mere hand-tightening of the backing-piece against the corresponding sleeve being sufficient.

After introduction of the duct 6, provided with the obturating device, into tube 1, in such a way that the sleeves 13 are located on each side of the series of holes 4 through which the injection will take place, a grout 25 or other material to be injected is sent into the duct.

The grout which penetrates through channels 11 and 12 into the body 8 of the obturating device first raises the skirt 14 of each of the sleeves 13 and inflates said skirt up to the moment where said skirt applies against the tube 1 as the case may be through shoulders 18 to delimit the above mentioned volume 7. As long as the pressure remains relatively low, the grout cannot get out of the sleeve 13 because the neck 15, narrower, tightened on the body 8, does not loosen from the latter.

When the pressure is sufficient to spread neck 15 apart from body 8, the grout flows out from the sleeve and runs into the space 7 which it fills at zero pressure. Then the pressure tends to raise to the value for which the outer bedding 3 breaks. The grout will then flow through holes 4 by spreading the flange 5 (FIG. 5). After a moment, the flow of grout comes to zero and the pressure only increases. The loss of pressure upon passage of the grout between the sleeve 13 and the body 8 comes then to zero and the skirt 14 tends to deflate.

Fortunately occurs a second phenomena, which is the transverse expansion of the thick bottom 16 of sleeve 13, compressed against backing-piece 19 and tube 1, under the effect of the pressure exerted by the grout flowing out from channels 12, as represented in FIG. 5.

When the skirt 14 is provided with peripheral shoulders such as 18 (FIG. 3) said shoulders limit the deformation of said skirt and help to the transverse expansion of the bottom.

In all cases said deformation of the bottom creates the formation of a safety rib 26 around flange 20 of the backing-piece 19, while the bottom 16 of the cap moves away from the end of body 8. The safety rib 26 persists even if the skirt 14 deflates due to the absence of loss of pressure. Consequently, the pressure can continue to raise without any leak into tube 1 and can reach the value at which breaking of bedding 3 occurs. Then the grout can again inflate the neck 15 and again create the loss of pressure required for applying the skirt 14 against tube 1. (FIG. 5).

However it is to be noted that said second applying is not essential, because the bottom 16 remains expanded and, itself, acts as a packing, like a toric joint. The skirt 14 and the neck 15, act then as a device for initiating the compression of bottom 16.

The disadvantages of the conventional systems with rings or with loss of pressure, disappear because, during the injection, the grout cannot set between the sleeve 13 and the rods 9 and 10 since it is entirely swept towards the outlet 15 without any accumulating point. Between the injections, the sleeve sticks again to the body 8 and the grout remaining in the ducts has no time to set.

The initial loss of pressure required for the inflation of the skirt 14 tends to decrease as soon as the flow increases since the outlet is enlarged.

The sleeve 13 essentially works in compression while it is known that the usual sleeves, set at the ends thereof on a rigid frame, work in tension and finally get unset. The compression stresses apply the bottom 16 against the backing-piece 19, without being necessary to set said backing-piece on said bottom, which ensures a mounting and a removal practically instantaneous with a minimum of parts.

The invention can be used for the obturation of any cavity relating to any sorts of fluids. It gives especially favourable results for the injections of grout as mentioned above.

The present invention is not restricted to the embodiment shown and described in detail, for various modifications thereof can moreover be applied thereto without departing from the scope of this invention, as defined in the appended claims.

I claim:

1. Obturating device for injection tubes or the like cavities comprising in combination a hollow body adapted to be connected to a duct for feeding into said body a fluid under pressure to be injected, said body being provided with at least an outlet port for said fluid; a flexible and resilient sleeve tightly engaged over one end of said body and covering said outlet port, said sleeve being provided with a relatively thick bottom located between said one end of said body and a backing-piece secured to said body, the assembly of said body, said sleeve and said backing-piece being adapted to be introduced in a cavity to be obtured with a clearance sufficiently small that the deformation of the bottom of said sleeve under the effect of the pressure of said fluid ensures the obturation of said cavity.

2. Device as claimed in claim 1, wherein the sleeve comprises at its end remote from said bottom, a neck narrower than said body, whereby upon engagement of said sleeve over said body a pre-stressing of said end is produced which causes momentarily a loss of pressure ensuring the inflation of the part of the sleeve located between said bottom and said end at the beginning of the fluid passage.

3. Device as claimed in claim 1, wherein the sleeve is provided with at least one external peripheral shoulder.

4. Device as claimed in claim 1, wherein said backing-piece is provided with a flange which covers only a portion of the bottom thickness.

5. Device as claimed in claim 1 wherein the sleeve bottom is crossed through by a rod on which is mounted said backing-piece.

6. Device as claimed in claim 5, wherein said rod is tubular and is adapted to be connected with said feeding duct.

7. Obturating device adapted to be used with an injection tube provided with outlets associated to non-return valves, comprising in combination a hollow body adapted to be connected to a duct for feeding into said body a fluid under pressure to be injected, said body being provided in the vicinity of each of its ends with outlet ports for said fluid; flexible and resilient sleeves tightly engaged over the ends of said body and respectively covering said outlets, each said sleeve being provided with a relatively thick bottom located between the corresponding end of said body and a backing-piece secured to said body, the assembly of said body, said sleeves and said backing-pieces being adapted to be slid in said injection tube with a clearance sufficiently small that deformation of said bottoms of said sleeves under the effect of the pressure of said fluid ensures the obturation of said tube.

8. Device as set forth in claim 7 wherein said hollow body is provided with a longitudinal channel communicating with said outlet ports.

9. Device as claimed in claim 7 wherein the bottoms of said sleeves are provided with a hole, said body being provided at its ends with a hollow rod passing through the hole of the corresponding sleeve and on which the corresponding backing-piece is mounted, one of said rods being connected with said duct and the other rod obturated.

10. Device as claimed in claim 9 wherein said backing pieces are screwed onto said hollow rods, said duct being secured to one of said pieces and an obturating cap secured to the other piece.

* * * * *